US006022276A

United States Patent [19]

Knijpstra

[11] Patent Number: 6,022,276

[45] Date of Patent: Feb. 8, 2000

[54] CAROUSEL

[75] Inventor: Hette Knijpstra, Terband-Heerenveen, Netherlands

[73] Assignee: Knijpstra Konstruktie B.V., Netherlands

[21] Appl. No.: 09/160,233

[22] Filed: Sep. 24, 1998

[30] Foreign Application Priority Data

Sep. 25, 1997 [DE] Germany ..... 197 42 260

[51] Int. Cl.[7] ..... A63G 1/28

[52] U.S. Cl. ..... 472/33; 472/47

[58] Field of Search ..... 472/29, 31, 32, 472/33, 47, 130

[56] References Cited

U.S. PATENT DOCUMENTS

| | | | |
|---|---|---|---|
| 2,436,014 | 2/1948 | Messier | 472/33 |
| 4,428,576 | 1/1984 | Fisher, Jr. | 472/33 |
| 4,842,267 | 6/1989 | Kastner | 472/32 |
| 5,791,998 | 8/1998 | Moser et al. | 472/31 |

FOREIGN PATENT DOCUMENTS

| | | |
|---|---|---|
| 44689 | 2/1888 | Germany . |
| 8908896 | 10/1989 | Germany . |

*Primary Examiner*—Kien T. Nguyen
*Attorney, Agent, or Firm*—Thomas M. Freiburger

[57] ABSTRACT

The present invention relates to a carousel with an upper rotating beam (2) arranged on a central mast (1). Carrier rods (3) carrying gondolas or seat carriers (4) are arranged in the circumference of the rotating beam, which may be swiveled outwards and inwards. According to the invention the carrier rods can by inducement of force be swiveled outwards and inwards at angles to the radial or circumferential direction of the rotating beam, which, particularly with the alternate swiveling of successive carrier rods (3) on the rotation, reduces the entire floor space for the carousel and increases the passenger frequency.

19 Claims, 4 Drawing Sheets

CAROUSEL

BACKGROUND OF THE INVENTION

This invention relates to a carousel. part of claim 1.

Such a carousel is provided with an upper rotary arm that is carried on a central mast. Outward/inward pivotable supporting rods carry gondolas or seats in the circumference of the rotary arm.

EP 0 325 783 discloses a carousel with a rim bearing rotatable around a central mast. Both ends of the rim bearing have gondola carriers that are arranged around a substantially vertical axis and carry several hanging gondolas. When the gondola carrier is rotating the centrifugal force drives the individual gondolas outward around the rotation axis of the gondola carrier because the gondola suspension on the gondola carrier is freely movable. The gondolas describe a circular movement around the axis of the gondola carrier. Taking into account the fixing of the gondola carriers to the rim bearing, the individual gondolas perform a circular spiral movement in relation to the central mast.

To increase the riding inducement the rotation axis of the rim bearing is preferably arranged angularly to the vertical, thereby making possible an additional vertical up and down movement of the passenger gondolas apart from the described movement.

DE 29 52 032 discloses a carousel with a central mast and an upper carrier with gondolas rotatable around the mast axis. The gondolas can be swivelled about a respective axis running in circumferential direction of the carrier. During the ride the individual carrier can be moved upward and downward vertically.

With so-called chairoplanes several passenger seats are freely suspended by chains on a beam rotatable around a central mast. During rotation centrifugal force swings the seats outwards. Here it is also known to achieve a so-called wave flight through an angular position of the rotation axis of the rotating beam. Instead of using chains the passenger seats may also be mounted pendulously on the rotating beam by rigid rods. The disadvantage of such chairoplanes versus rod carousels is that during a ride the passenger seats describe only circular movement, possibly with an additional horizontal movement and due to the centrifugal force the entire interior of the carousel is not used during the ride.

DE-GM 72 01 854 discloses a carousel with several extension arms that are mounted on a middle part rotatable around a vertical axis. The extension arms can be swung around axes running tangentially to the middle part and they may be lifted by driving power. Freely suspended seat cage carriers are mounted on the ends of the extension arms.

DE 32 34 279 discloses a carousel with several passenger gondolas suspended on extension arms through by means of freely swivelling gondola arms. By means of power transmitters the gondolas may be moved freely swinging beyond the position reached through centrifugal force.

DE 87 01 462 relates to a similar carousel with rigid extension arms movable by force in a radial direction to the central column, the gondolas being suspended freely swinging on the extension arms.

DE 89 08 896 relates to a carousel with radial arms which can be swivelled through application of force, whereby the gondolas mounted on the arms are additionally provided with a rotatable pendulum axis may also be swivelled by force.

Finally, DE-PS 44 689 discloses the possibility of developing a reverse movement of respectively opposite passenger gondolas.

It is the object of the invention to provide a new carousel which provides more excitement, needs little floor space and may be flexibly controlled but which, at the same time, accommodates more passengers.

SUMMARY OF THE INVENTION

According to the invention the carrier rods for gondola or seat carriers may be swung outward/inward through controlled force in relation to the circumferential path of the rotating beam, whereas the swiveling axis of the carrier rods at the rotation beam runs obliquely in relation to the radial and circumferential direction of the rotating beam. The flight radius of the gondola or seat carriers may be adjusted as required. It is therefore possible to shift the flight radius both farther inward, toward the mast, and farther outward, i.e. farther than the extent which would result from the centrifugal force with freely suspended gondola or seat carriers. As it is thus possible to set the flight path the operational radius of the carousel may be adjusted to a restricted area on a fairground. This makes it possible also to further reduce the floor space of the carousel, e.g. by diverting the carrier rods slightly inward to the mast for the passengers to get on or off, thereby reducing the outer perimeter of the seat or gondola carrier area considerably.

When a carrier rod is diverted inward toward the mast with an angle of e.g. 30°–60° to the radial direction of a carrier rod in the plane of the rotating beam a further inward diverting of the carrier rod may be effected without the risk of the seats or gondola carriers touching the central mast or its covering, as the seats or gondola carriers are diverted no farther than the tangential direction to the mast or its covering.

The swiveling axis of the carrier rods preferably runs in the plane of the rotating beam, especially i.e. in a horizontal plane. It is also possible to arrange the swiveling axis in relation to the plane of the rotating beam at an angle deviating from this plane, so that diverting of the carrier rods in radial direction leads to a respective movement of the carrier rod forward and/or backward relative to the circumferential direction of the rotating beam.

In a preferred embodiment of the invention the carrier rod is partitioned into two rod sections joined by a hinge. The produced movement of the rod sections causes the lower rod section that is fastened to the upper rod section through the hinge to describe an additional movement around the hinge. In particular, if the preferably freely movable rotation axis of the hinge runs at a right angle to the rotation axis of the hinge between the upper rod section and the rotating beam the seats gondola carriers describe an additional movement, namely a pendulum movement about the hinge, which, depending on the length ratio of the rod sections, results in a circular or oval movement of the seat and/or gondola carriers around the ends of the rotating beam. The rotation axis of the hinge is preferably provided with a damping means, e.g. for obtaining a quick standstill of the carousel after a ride. Damping may be achieved by pneumatic springs, brake blocks, hydraulic cylinders or tension springs.

In a particularly preferable embodiment of the invention the horizontal swinging of the carrier rods following each other in the circumferential direction of the rotating beam is effected antagonistically inward and outward in relation to the circumferential circle. The seat or gondola carriers can therefore not obstruct each other when swinging, as only ever second carrier rod is swung inward while the intermediate carrier rod is swung outward. A special advantage of this embodiment of the invention si that the gondola or seat carriers may be arranged very close to each other in the periphery of the rotating beam without possibility of contact between the seat or gondola carriers of different carrier rods during inward swinging of the carrier rods. This arrangement is also advantageous as it reduces the floor space of the carousel even further and at the same time it is possible to accommodate more passengers, because during a run practically all the time the entire carousel space is used by the alternate swiveling of the seat or gondola carriers inward/outward. Although this makes possible use of the carousel as a chairoplane, it is possible to achieve an additional driving experience resulting from an inward/outward swiveling which is not possible with conventional chairoplanes.

To render a recurring sequence of swiveling inward/outward movements possible, the carousel should preferably have an even number of rotating beam arms or carrier rods.

The swiveling movement of the carrier rods may be effected by mechanical force, e.g. with a cable, a chain et., or with a hydraulic or pneumatic drive or an electric motor. For the alternate inward/outward swinging of the carrier rods the movements of the successive carrier rods may be synchronized through a suitable control device. When a carousel only uses a rotating beam with few, e.g. four arms, it is possible to do without synchronizing the swinging of the carrier arms. The individual carrier arms will then have sufficient freedom of motion, therefore avoiding obstruction.

When the velocity of swinging inward and outward is matched to the length of the carrier rods the swinging of the carrier rods may be carried out as a pendulum motion, so that the expenditure of energy for this movement may be kept very low.

A particular embodiment of the invention may include that the inwards and outwards swinging of the carrier rods is limited to few or alternately activated carrier rods.

For an even stronger inducement the rotating beam may be liftable and lowerable in the vertical direction. The rotating beam may also be pivotable around the axis running at an angle to the vertical line, so that a vertical movement of the passenger carriers or gondolas during rotation around the mast is additionally possible. A wave motion produced by a pivotable angular axis of the rotating beam is also possible.

The seat carriers or gondolas may be pivotable as a group or pivotable through their own axes parallel with the axis of the carrier rods and, if desired, also by a separate drive. It is also possible to have the seat carrier pivot additionally around an axis that is horizontal in the idle position, so that toppling over of the seat carriers is also possible.

Preferably five pairs of seat carriers, set off at 72° angles, are arranged on the lower ends of the carrier rods.

In a particular embodiment of the invention the rotating beam of the carousel has four arms each containing fivefold two seats, so that the total capacity of the carousel is 40 passengers for one ride.

DESCRIPTION OF THE DRAWINGS

In the following an embodiment of the invention is described by way of example. Reference is made to the accompanying drawings.

DESCRIPTION OF PREFERRED EMBODIMENTS

Figure 1:
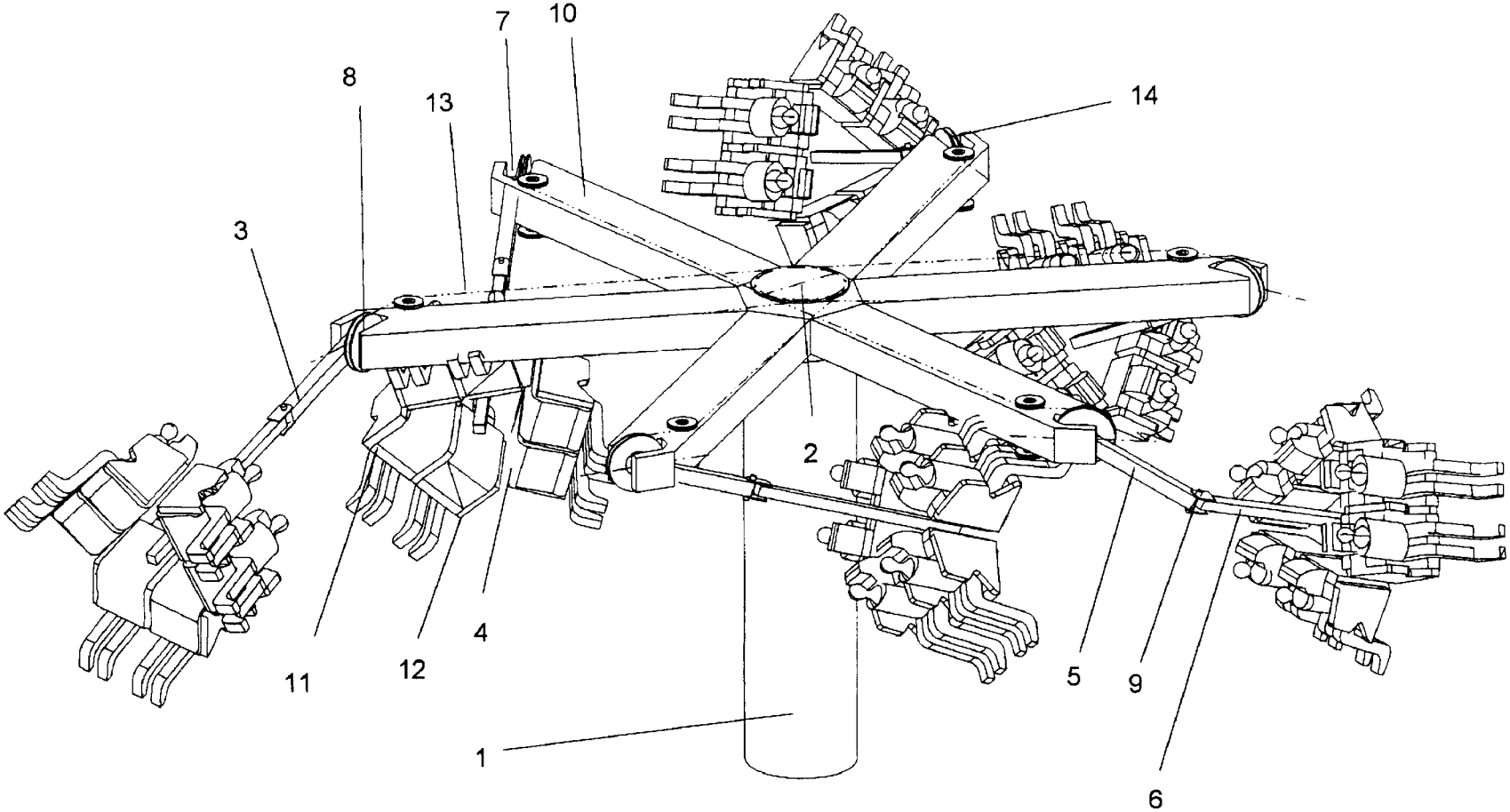
FIG. 1 shows a perspective oblique view of a carousel according to the invention in operation.

FIG. 1 shows a central mast 1 on the upper side of which a rotating beam 2 is pivotably mounted. If desired, the rotation axis of the rotating beam 2 is swung in relation to the axis of the mast at an angle in relation to the vertical line, whereas the rotation axis itself may be revolving. Corresponding devices for the adjustment of the rotation axis are known from the state of the art.

The rotating beam of the described embodiment has six arms 10, each of them carrying carrier rods 3 mounted in a suspended manner through a hinge 8 in a fork 7. The number of carrier rods may be changed, e.g. to four. The rotation axis of the carrier rods 3 does not run in tangential direction to the rotating beam but at an angle of 30–60° to the tangent, so that by swiveling of a carrier rod the swiveling plane of the carrier rod runs about tangentially to the mast or its covering. The carrier rods 3 are swivelled outward/inward by force inducement, so that they may, as illustrated, experience a wide swinging outward but also a wide swinging inward. The swiveling may be effected, e.g., by a cable 13 through a cable pulley 14, which is mounted on the swiveling axis 8 in the fork 7.

The right side of FIG. 1 shows a carrier rod 3 consisting of two rod sections, an upper rod section 5 and a lower rod section 6, which are joined by a hinge 9. The hinge axis of hinge 9 runs at a right angle with the swiveling axis 8 between carrier rod 3 and rotating beam 2 and is freely rotatable. It is also possible (not shown) to control the hinge 9 by force inducement (e.g. with an electric motor) to set determined flight paths as desired.

Free movement of the hinge 9 has the effect that with the swinging outward or inward of the carrier rod 3 the lower rod section 6 is swivelled oscillating around hinge 9, so that, when being swung outward/inward the gondola or seat carriers 4 describe a circular or elliptical movement in relation to the rotating beam 2. The elliptical shape is determined by the length ratio of the rod sections 5 and 6. Free movement may also be restricted by assigning a brake device to hinge 9, e.g. pneumatic springs, brake blocks or tension springs. This minimizes uncontrolled pendulum movement.

The illustration clearly shows that, in contrast to a chairoplane, a continuous movement of the gondola or seat carrier in the carousel space may be achieved. Although it is also possible to achieve a movement in which the carrier rods 3 are solely swung due to the centrifugal force of the seat or gondola carriers 4, thereby inducing a circular movement of the seat or gondola carriers, it is preferred for the invention that on the periphery of the rotating beam 2 successive carrier rods 3 are alternately swung inward and outward. When the swinging velocity is adjusted to the length of the carrier rod 3 it is possible to support a natural pendulum movement so that only the pendulum losses have to be compensated. This means the power demand for maintaining the swinging movement is relatively small. A wide inward/outward swinging of the gondola or seat carrier 4 may be achieved with sufficient force. The pendulum movement will then be in a circular path developing due to the centrifugal force ratio during a ride.

In a further embodiment of the invention it is also possible to use telescopic carrier rods 3 enabling changed swinging frequencies. When the carrier rods are arranged on a swinging spring the carrier rods become shorter when swinging inward whereas they become longer when swinging outward, thereby causing an additional riding experience.

Figure 2:
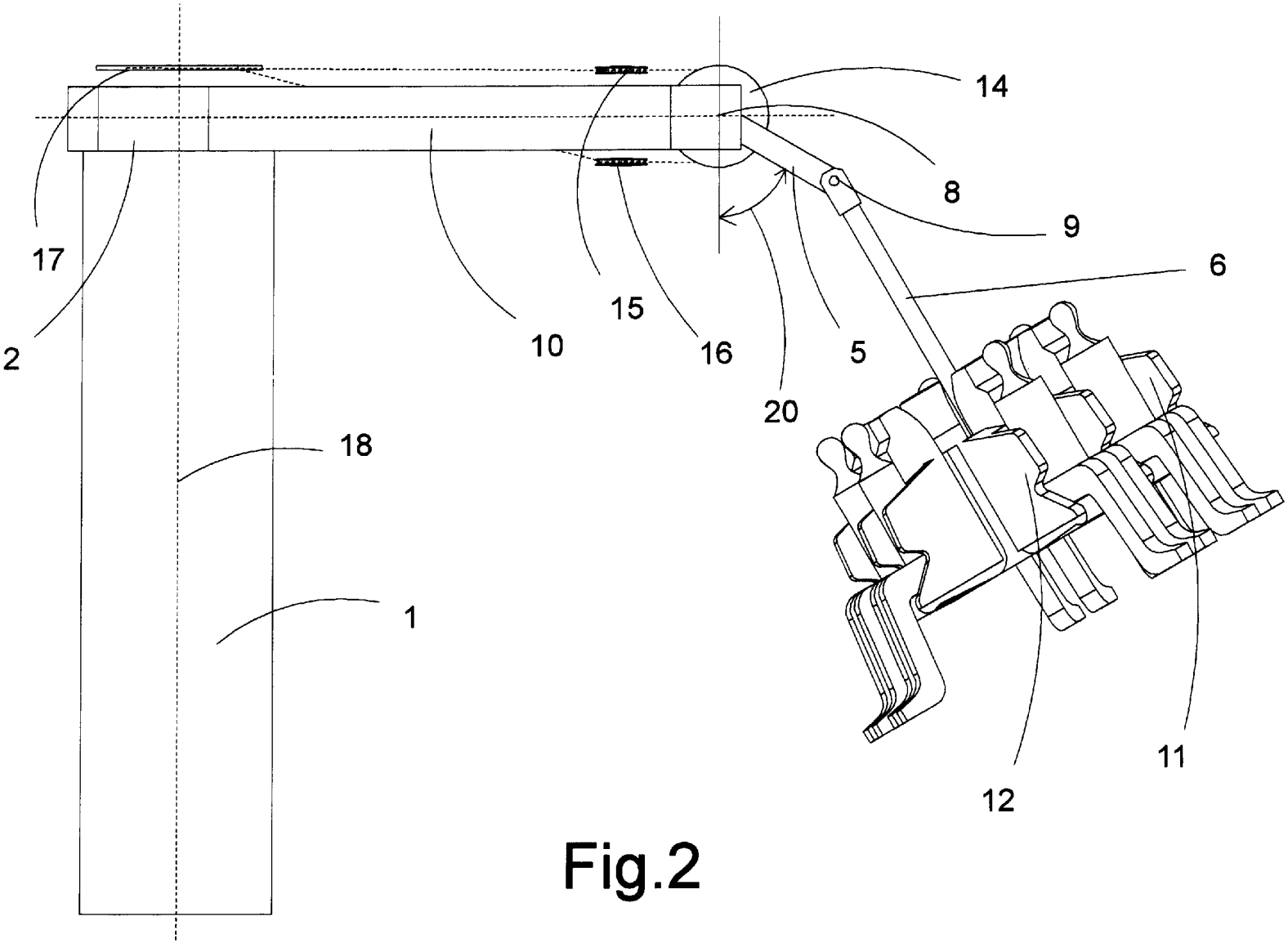
FIG. 2 shows a side view of an arm of the carousel with an outwardly swung carrier arm.

FIG. 2 shows a side view of an arm of rotating beam 2 with a pivotably connected carrier rod. Swinging of the carrier rod 3 is to be carried out through a cable 13 directed around the cable pulley 14. The cable guide runs around cable pulley 14, idle pulleys 15, 16 and cam pulley 17. Rotation of the cam pulley 17 induces rotation of cable pulley 14 and therefore an outward swinging of the carrier rod 3 that is linked with the cable pulley. Cam pulley 17 may at the same time cause a swinging out of all carrier rods 3 on the different arms of the rotating beam 2. The rotation direction of the cable pulleys 14 on the rotating beam 2 of successive carrier arms 10 is here respectively in the opposite direction, e.g. by an intersecting cable. With only few arms on the rotating beam, e.g. four, it is also possible to do without synchronization and coupling of successive carrier rods.

Swinging of the carrier rods 3 outwardly is effected by an angle 20. A respective inward swinging may be effected with the same angle. This is, however, not imperative. To keep the necessary energy for outward swinging as low as possible the swinging out of the carrier rods is carried out outward and inward at the same angles, starting from an idle position resulting from the centrifugal force ratio of the carrier rods with the rotation of the carousel.

FIG. 2 shows a rotating beam 2 rotating at right angles around the center-axis 18 of mast 1. Rotation of rotating beam 2 may also be effected around a fixedly adjusted or rotating angular axis, so that during rotation around the rotation axis a vertical upward and downward movement of the seat or gondola carrier due to the lifting or lowering of the ends of arms 10 of the rotating beam is also possible.

The rotating beam may also be lifted entirely in its height.

FIG. 2 shows that on the lower ends of the carrier rods there are seats 11, 12 arranged in pairs. These may be arranged in fixed positions. The whole group of seats may, however, also be arranged for freely or positively controlled rotation around the longitudinal axis of lower rod section 6. The seats may further be arranged on a seat carrier secured on one of the rod sections 6 and they may be movable individually or in pairs. It may also be possible to rotate or swivel seats 11, 12 individually or in pairs around a rotation axis which runs at right angles about the lower rod section and swinging horizontally during idle position, also enabling the seats or seat groups to topple over.

Figure 3:
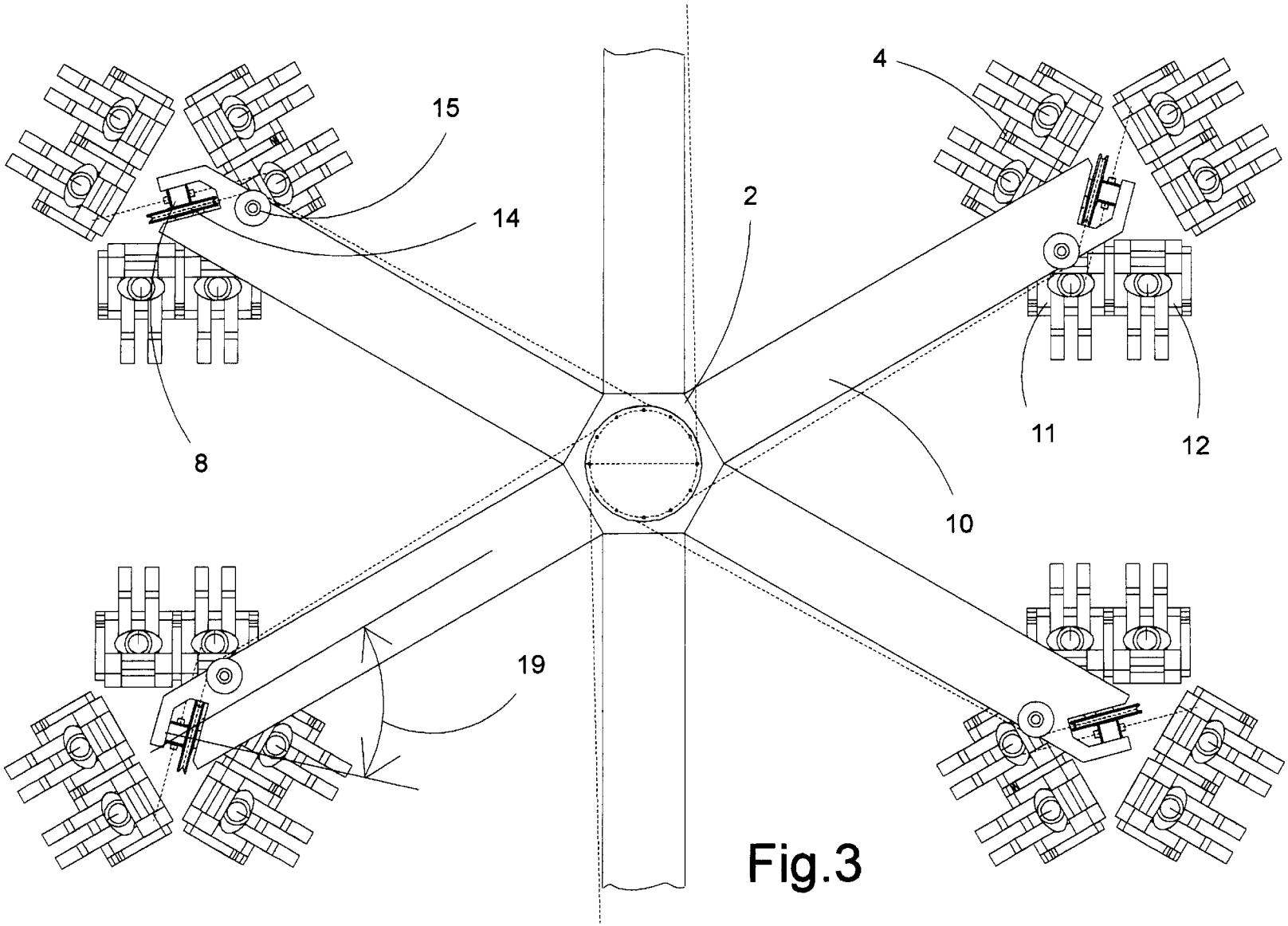
FIG. 3 shows a plan view of the carousel according to the invention in the idle position, two arms having been omitted for better illustration.

FIG. 3 is a top view of a carousel according to the invention. Six arms 10 of the rotating beam 2 are shown, while two of the ends of arms 10 are omitted for better illustration. The figure clearly shows that the swiveling plane of the carrier rods 3 carrying the seats is swung at an angle 19 with respect to the radial plane of the arms, so that an inward swinging of the carrier arms is not obstructed by mast 1 or its covering. For safety, inward swinging has to be restricted so that the passengers cannot contact an adjoining arm of the rotating beam when a carrier rod swings inward. When, however, the carrier rods 3 are so short that with a carrier rod swung inward the passengers' feet remain in the clearance between two adjacent arms of the rotating beam 2, in any case swinging inward may practically be effected up to the horizontal plane or even further.

Although FIG. 3 shows six arms of the rotating beam, it is to be noted that the number of arms is basically not restricted. If symmetrical inward and outward swingings are desired the number of arms should be even. The inward/outward swinging is preferably effected at 70°–90° angles with respect to the idle position resulting from the centrifugal force ratio, so that in use an outward swinging at 80°–100° and an inward swinging at 60°–80° with respect to the vertical line is effected.

Figure 4:
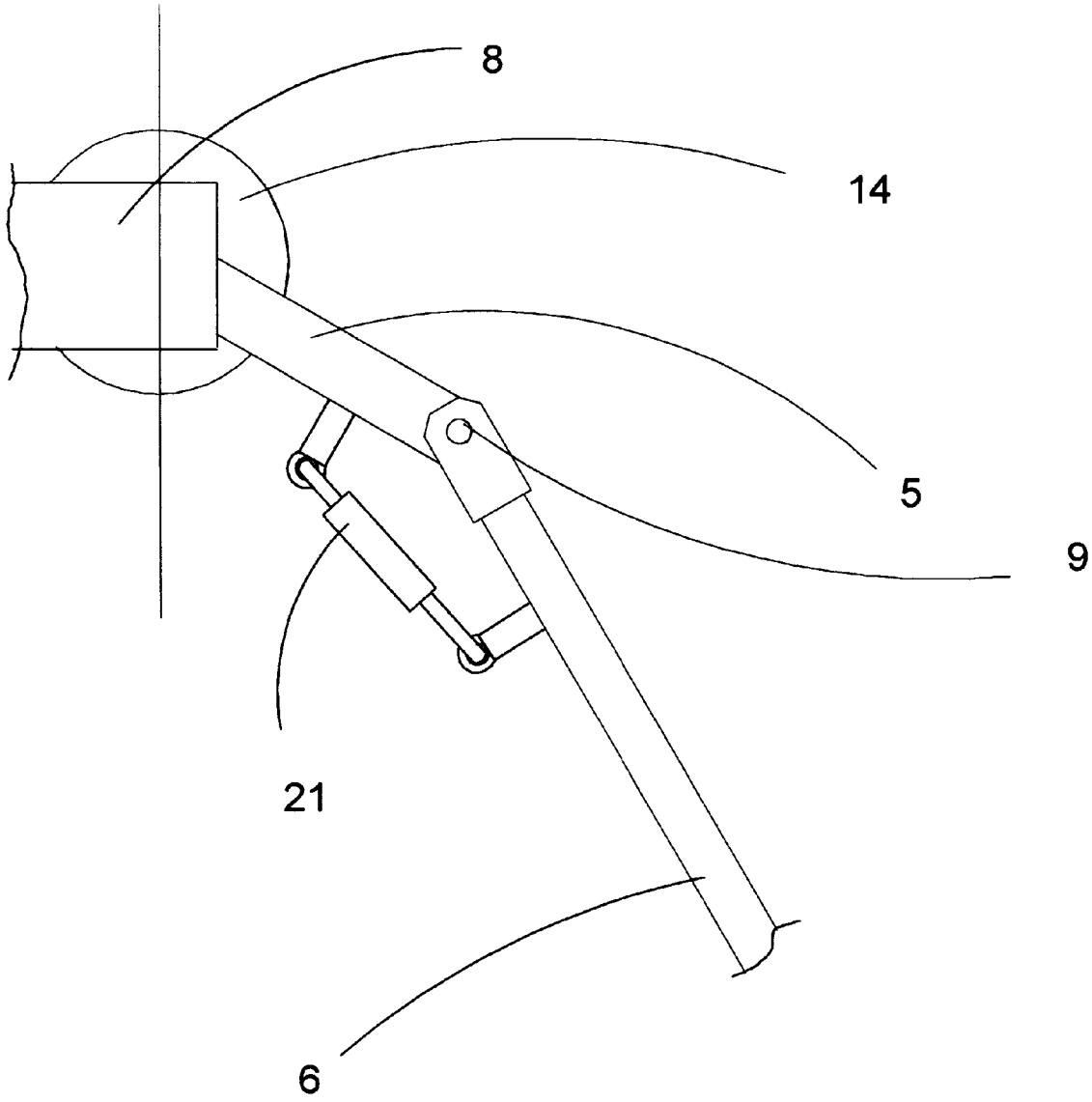
FIG. 4 is a schematic view indicating a damping device fitted onto a hinge of a carrier arm.

A damping device 21 is shown in FIG. 4 for the hinge 9. The device is shown as a hydraulic cylinder.

The control system of the carousel includes setting of the rotating motor for adjusting the rotation velocity of rotating beam 2, setting the swinging movement of the carrier rods 3 (at a fixed or an adjustable value), a potential tipping of the rotation axis of the rotating beam 2 and a potential lifting of the rotating beam 2 and, if necessary, additionally possible adjustments of the movement of the carousel. Rotation of the seat carriers may also be controlled. Control may be effected manually, but the carousel movement is preferably program-controlled. Different program runs may be used.

I claim:

1. In a carousel with a central mast arranged with an upper rotating beam, at the circumference of which carrier rods carrying gondolas or seat carriers are operated to swivel outward and inward in relation to the rotation path of the rotating beam, the improvement comprising that each of the carrier rods has an upper end pivotally connected to the rotating beam so as to define a swivel axis located at the circumference of the rotating beam, the swivel axis being oriented obliquely to the radial and circumferential direction of the rotating beam.

2. A carousel as claimed in claim 1, wherein the swivel axes run at 30°–60° angles in relation to the radial direction of the rotating beam.

3. A carousel as claimed in claim 2 wherein the swivel axes are arranged in a horizontal plane.

4. A carousel as claimed in claim 1, wherein the carrier rods are subdivided into two rod sections joined through a hinge.

5. A carousel as claimed in claim 4, wherein the hinge runs at right angles to the swivel axis of the carrier rod.

6. A carousel as claimed in claim 5, wherein in the idle position the hinge of the carrier rod lies in a horizontal plane.

7. A carousel as claimed in claim 4, further including a damping means coupled with the hinge for damping motion about the hinge.

8. A carousel as claimed in claim 7, wherein the damping means is one of a pneumatic spring, a hydraulic cylinder, a tension spring and a damping block.

9. A carousel as claimed in claim 7, further including means for controlling the degree of damping of the damping means.

10. A carousel as claimed in claim 4, wherein the seat carriers or gondolas are mounted on the lower ends of the carrier rods, the seat carriers or gondolas being rotatable around an axis that is parallel to the axis of the hinge.

11. A carousel as claimed in claim 1, wherein swiveling of successive carrier rods in the direction of rotation of the rotating beam takes place outward and inward in opposite directions.

12. A carousel as claimed in claim 11, wherein the number of carrier rods is 2n, whereas n is a natural number >0, and wherein during operation of the carousel n carrier rods are swiveled inward and inversely n carrier rods are swiveled outward in a pendulum motion.

13. A carousel as claimed in claim 1, wherein the swiveling motion of the carrier rods is carried out through mechanical force inducement by one of the following means: chains, cable, hydraulically, pneumatically, and electromotive means.

14. A carousel as claimed in claim 13, wherein the movement of the carrier rods is synchronized to each other.

15. A carousel as claimed in claim 14, wherein two respective successive carrier rods in the circumference of the rotating beam are coupled for inverse movements.

16. A carousel as claimed in claim 1, the rotating beam is rotatable around an axis running at an oblique angle to the vertical.

17. A carousel as claimed in claim 16, wherein on each carrier rod there are respectively mounted five seat carriers arranged 72° angles to each other.

18. A carousel as claimed in claim 16, wherein the respective seat carriers are capable of rotation around a rotation axis allowing toppling over.

19. A carousel as claimed in claim 1, wherein the rotating beam is provided with four to six arms on the ends of which there is connected one of the carrier rods and wherein each carrier rod carries five seat carriers each having two seats.

* * * * *